United States Patent [19]

Kawai

[11] Patent Number: 4,489,507

[45] Date of Patent: Dec. 25, 1984

[54] DRYING APPARATUS

[75] Inventor: Tsuneo Kawai, Toyota, Japan

[73] Assignee: Tokyo Shibaura Denki Kabushiki Kaisha, Japan

[21] Appl. No.: 409,347

[22] Filed: Aug. 18, 1982

[30] Foreign Application Priority Data

Oct. 9, 1981 [JP] Japan ..... 56-162181

[51] Int. Cl.[3] ..... F26B 21/02

[52] U.S. Cl. ..... 34/77; 34/131; 34/133

[58] Field of Search ..... 34/77, 86, 131, 133; 68/18 C; 165/166, DIG. 8

[56] References Cited

U.S. PATENT DOCUMENTS 3,032,887 5/1962 Whyte et al. ..... 34/43
4,377,201 3/1983 Kruse et al. ..... 165/166

FOREIGN PATENT DOCUMENTS 2143020 3/1972 Fed. Rep. of Germany ..... 165/166
2630551 1/1977 Fed. Rep. of Germany ..... 165/166
51-21181 2/1976 Japan .
53-141565 11/1978 Japan .
2002891 2/1979 United Kingdom ..... 34/77

*Primary Examiner*—Larry I. Schwartz
*Assistant Examiner*—David W. Westphal
*Attorney, Agent, or Firm*—Cushman, Darby & Cushman

[57] ABSTRACT

A drying apparatus includes a drum rotatably arranged in an outer box and housing therein materials to be dried. An air supply device supplies heated air into the drum, and a heat exchanger cools air discharged from the drum by means of air taken from outside of the outer box to remove moisture from air discharged. The heat exchanger is formed by piling plural plates with plural pairs of first and second closing plates interposed therebetween and is provided with plural first and second passages which are arranged alternately and perpendicularly to each other. The heat exchanger is so arranged that the first passages are slanted inward the outer box by 45 degrees relative to the vertical direction.

15 Claims, 4 Drawing Figures

DRYING APPARATUS

BACKGROUND OF THE INVENTION

The present invention relates to a drying apparatus and, more particularly, a drying apparatus wherein moist air discharged from a drum in which materials to be dried are housed is passed through a heat exchanger to remove moisture and then again supplied into the drum.

The drying apparatus of this type has an outer box and a drum arranged rotatably in the outer box and housing therein materials to be dried, such as underwear, for example, wherein materials are dried by supplying hot air into the drum. The drying apparatus also has a heat exchanger arranged in the outer box and moist air discharged from the drum is passed through the heat exchanger and then again supplied into the drum after its moisture is thus removed. The conventionally well known drying apparatus employs a pipe type heat exchanger having a plurality of pipes through which air discharged from the drum is passed, and a plurality of radiating fins fixed by welding to pipes. However, the pipe type heat exchanger type becomes complicated in construction and needs troublesome weldings, thus making the assembly capacity low and the manufacturing cost high. In addition, water drops formed on the inner surfaces of pipes in the heat exchanger flow in a direction reverse to the direction in which air flows through pipes, so that water drops are pushed back by air flowing through pipes. The pipe type heat exchanger therefore has a low drain efficiency for water drops, which causes the pipe type heat exchanger to exhibit a low moisture removing efficiency.

SUMMARY OF THE INVENTION

The present invention is intended to eliminate these drawbacks and the object of the present invention is therefore to provide a drying apparatus having a heat exchanger which is simple in construction, low in manufacturing cost, and capable of draining water drops with a high efficiency.

According to an aspect of the present invention, the drying apparatus comprises an outer box sealed substantially air-tightly, a drum arranged rotatably in the outer box and housing materials to be dried therein, a driving means for driving the drum, an air supply means for supplying heated air into the drum to remove moisture from materials to be dried, and a heat exchanger for cooling air discharged from the drum with air outside to remove moisture from moist air discharged from the drum.

The heat exchanger comprises at least one assembly including first, second and third plates, the first and third plates facing to the second plate to be apart therefrom; a pair of first closing plates arranged between first and second plates, facing each other in a predetermined distance to form a first passage through which air discharged from the drum flows; a pair of second closing plates arranged between second and third plates, facing each other in a predetermined distance to form a second passage which extends at right angles to the first passage and through which air outside is allowed to flow, heat being exchanged through the second plate between the air streams within the first and second passage; and the assembly being so arranged in the outer box that the first passage extends inclined by a predetermined angle relative to the vertical direction, allowing water drops, which have been formed on first and second plates by air flowing through the first passage, to flow by their gravity along first and second plates.

The drying apparatus further includes means for receiving water drops arranged under the heat exchanger.

According to the drying apparatus of the present invention as described above, the heat exchanger formed by flat plates and closing plates becomes simple in construction and can be assembled with reliability and manufactured in low cost. In addition, the heat exchanger formed by flat plates and closing plates includes the first passage inclined by a predetermined angle relative to the vertical direction. Therefore, water drops condensed on flat plates in the first passage flow by gravity in a vertical direction, while air flowing through the first passage is allowed to flow inclined relative to the vertical direction, thus preventing the flowing direction of water drops from becoming reversed thereby smoothly draining water drops. The heat exchanger is therefore excellent in the efficiency of draining water drops while also enhancing the moisture removing efficiency of the heat exchanger.

BRIEF DESCRIPTION OF THE DRAWINGS

FIGS. 1 through 4 show an embodiment of drying apparatus according to the present invention, in which FIG. 1 is a front view, FIG. 2 a longitudinally sectioned view along a line II—II in FIG. 1, FIG. 3 a cross-sectioned view along a line III—III in FIG. 1 and FIG. 4 a perspective view showing a heat exchanger.

DETAILED DESCRIPTION OF THE PREFERRED EMBODIMENT

Figure 1:
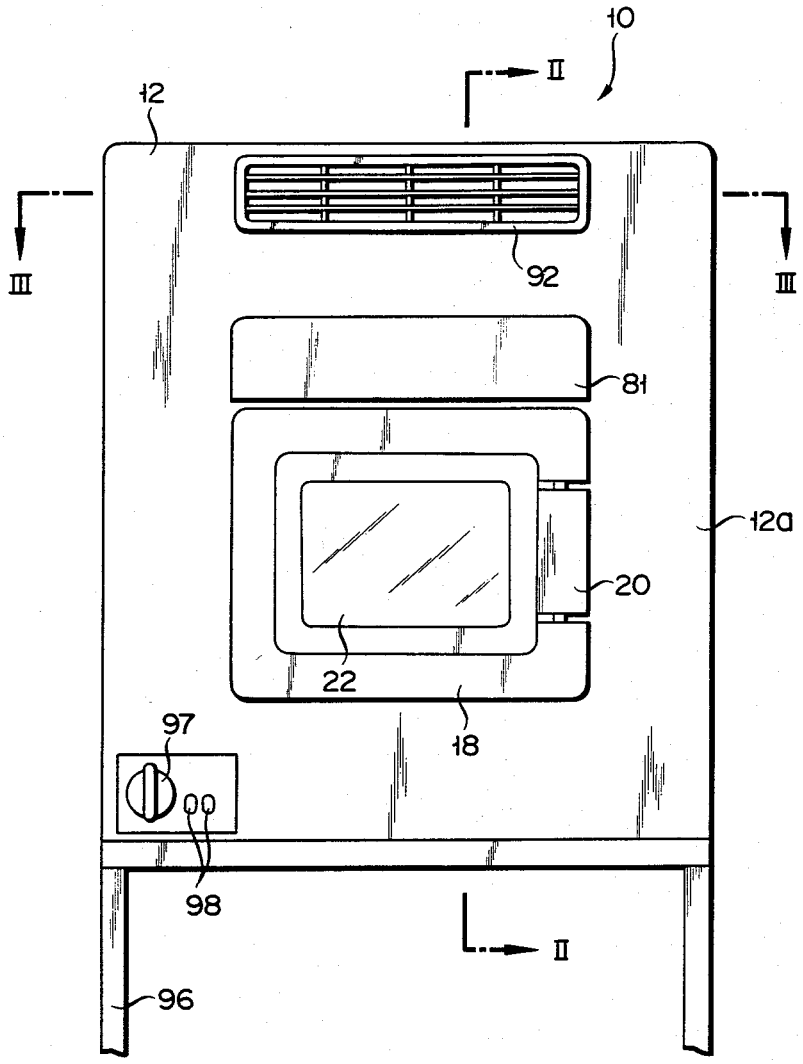

An embodiment of the present invention will be described in detail referring to FIGS. 1 through 4. Drying apparatus 10 has a outer box 12 of rectangular solid, and drum 24 arranged rotatably in the outer box 12. The drum 24 is arranged with a predetermined distance spaced from the inner surface of the outer box 12 to form a space 25 between the inner surface of the outer box and the outer surface of the drum 24. In the center of a front panel **12*a* of the outer box 12 is formed a rectangular opening 16 through which materials such as under wears, for example, to be dried are put into or taken out of the drum 24. A side-hinged door 18 for closing the opening 16 is arranged on the front panel 12*a* and provided with a handle 20 at the right side end and a window 22** of transparent glass in the center thereof.

Figure 2:
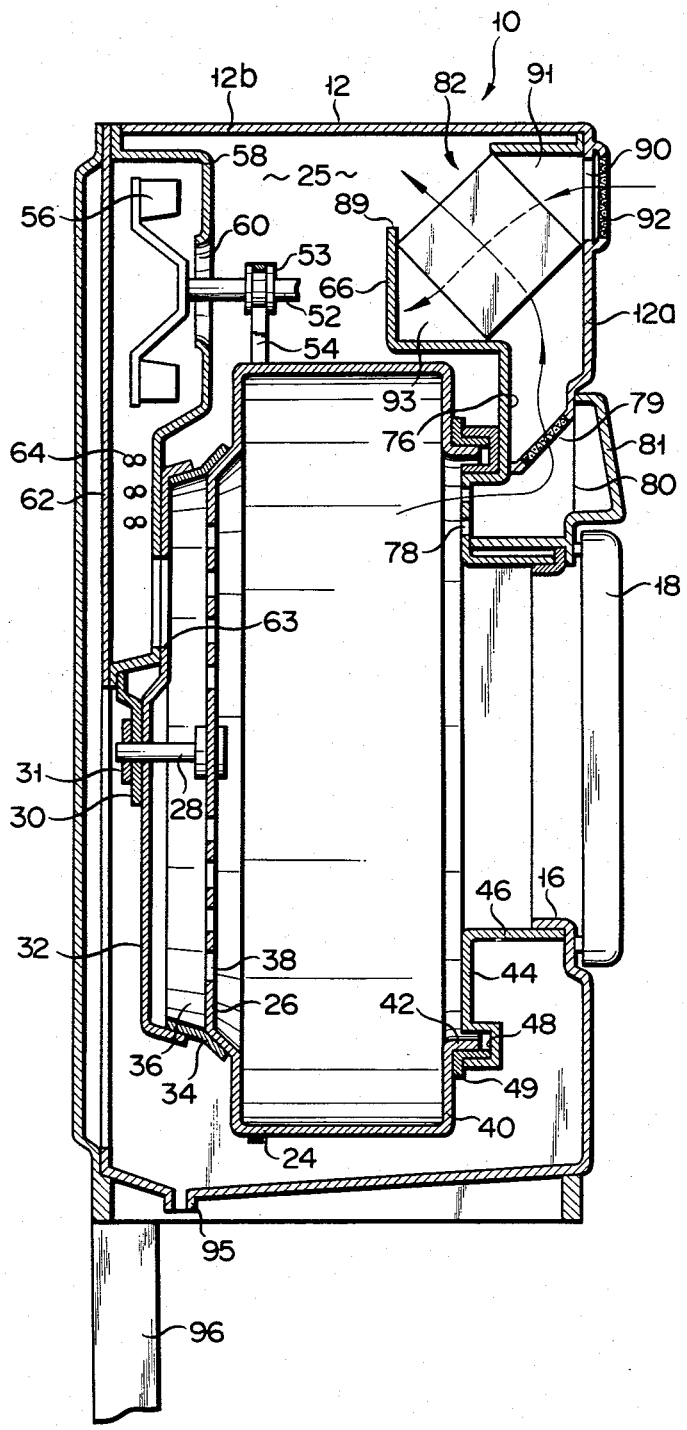

As apparent from FIG. 2, the drum 24 is of cylinder and closed by an end plate 26 at the back end thereof. The end plate 26 has a support shaft 28 projected backward from the center thereof and supported rotatably through a bearing 31 by a support plate 30 in the outer box 12. A wind spreading member 32 of circular tray is fixed, coaxial with the drum 24 and parallel to the end plate 26, to the support plate 30. The circumference of the wind spreading member 32 is air-tightly contacted with the end plate 26 through a sealing member 34 to thereby define a cavity 36 between the wind spreading member and the end plate 26. The end plate 26 has a plurality of ventilating bores 38 to communicate the cavity 36 with the drum 24. The drum 24 has at the front end thereof a ring-shaped end plate 40, which has a cylindrical portion 42 coaxial with the drum. The cylindrical portion 42 is rotatingly supported by a drum supporting plate 44, which is arranged inside the front panel 12*a* of the outer box 12 with a predetermined distance spaced from the front panel 12*a*. The drum support plate 44 is positioned enclosing the opening 16 of the front panel 12*a* and provided with a cylindrical portion 46 communicated with the opening 16. The drum support plate 44 is also provided with a circular support groove 48 formed coaxial with the drum 24 and enclosing the opening 16. The cylindrical portion 42 of the drum 24 is rotatingly supported in the support groove 48 through a bearing member 49.

Figure 3:
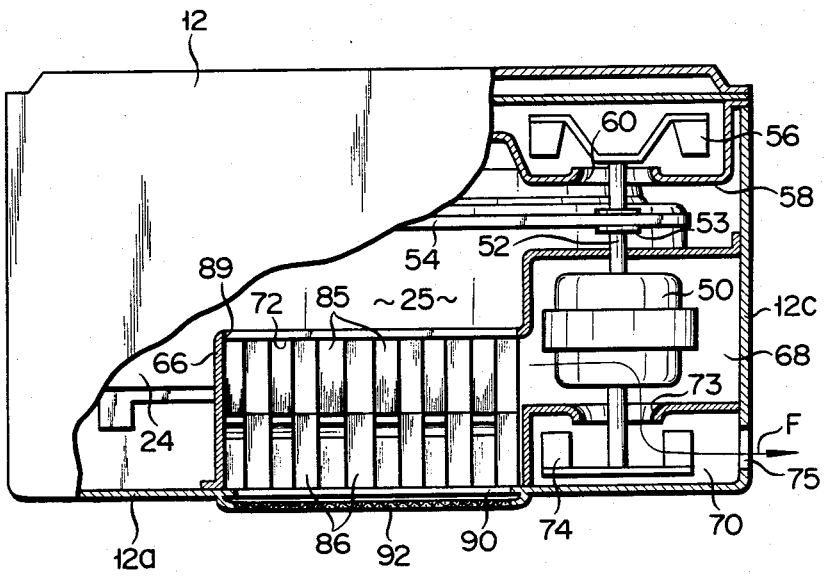
Figure 4:
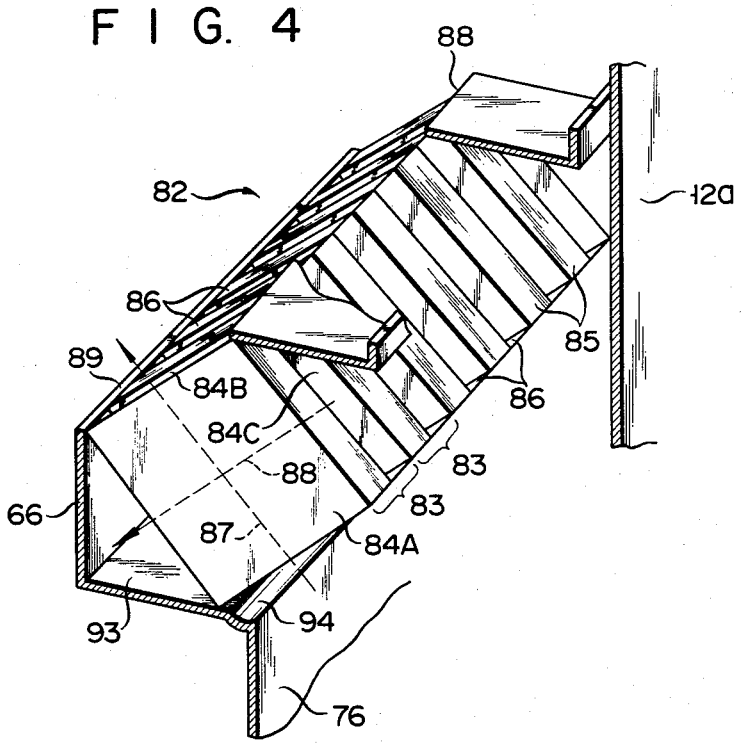

As shown in FIG. 3 and 4, drying apparatus 10 includes a motor 50, which serves as a driving means to rotate the drum 24. The motor 50 is attached to an upper panel 12*b* of the outer box 12, positioning its rotating shaft 52 parallel to the center shaft of the drum 24. A pulley 53 is attached to the back end portion of the rotating shaft 52 and rotates integral with the rotating shaft 52. A belt 54 is stretched between the pulley 53 and the drum 24, whereby the drum 24 is rotated by the motor 50 through the pulley 53 and the belt 54. A fan 56 is fixed to the back end of the rotating shaft 52 and rotates integral with the rotating shaft 52. The fan 56 is housed in a fan casing 58 fixed to the outer box 12. The fan casing 58 has a suction opening 60 opened inside the outer box 12 and is communicated with one end of a duct portion 62, the other end of which is communicated with a suction hole 63 formed in the wind spreading member 32. A heater 64 is arranged in the duct portion 62 and air passing through the duct portion is heated by the heater 64. The duct portion 62, heater 64, and fan 56 form an air supply means for supplying heated air into the drum 24.

Drying apparatus 10 also includes a case 66 positioned above the drum 24 and fixed to inner surfaces of front and side panels 12*a* and 12*c* of the outer box 12. The case 66, front and side panels 12*a* and 12*c* define a motor chamber 68, a fan chamber 70 and a heat exchanger chamber 72, respectively. The motor 50 is arranged in the motor chamber 68 with the back end portion of its rotating shaft 52 extending backward through the case 66. The motor chamber 68 is communicated with the fan chamber 70 through a communicating opening 73 and the front end portion of the rotating shaft 52 extends through the communicating opening 73 into the fan chamber 70. A fan 74, which constitutes a part of the air supply means, is attached to the front end of the rotating shaft 52 in the fan chamber 70 and rotates integral with the rotating shaft 52. The fan chamber 70 is communicated with outside the outer box 12 through a discharging opening 75 formed in the side panel 12*c*. The heat exchanger chamber 72 is of rectangular solid and extends horizontally along the front panel 12*a*. The case 66 has a ventilating cylinder portion 76 extending downward therefrom to form a ventilating path and communicated with the heat exchanger chamber 72. The projected end of the ventilating cylinder portion 76 is communicated with the drum 24 through an air discharging hole 78 formed in the drum support plate 44. A lint filter 79 is arranged in the ventilating cylinder portion 76, which is communicated with outside the outer box 12 through an opening 80 formed in the front panel 12*a*. The lint filter 79 is cleaned through the opening 80, which is closed by a cover 81 detachably attached to the front panel 12*a*.

A heat exchanger 82 is arranged in the heat exchanger chamber 72, as shown in FIG. 2 through 4. The heat exchanger 82 has a plurality of assemblies 83, each of which has first, second and third plastic plates 84A, 84B and 84C, said first plate 84A being spaced by a predetermined distance from and opposite to one face of the second plate 84B while said third plate 84C being spaced by a predetermined distance from and opposite to the other face of the second plate 84B. First, second and third plates 84A, 84B and 84C are formed square and juxtaposed parallel to one another and in a predetermined direction. Each of assemblies 83 also has a pair of first closing plates 85 arranged between first and second plates 84A and 84B, and a pair of second closing plates 86 arranged between second and third plates 84B and 84C. Each of first and second closing plates 85 and 86 is made of plastic and formed rectangular having long sides equal in length to one side of the first plate 84A and short sides equal in length to the distance between two adjacent plates. Each long side of one of the first closing plates 85 is put in contact with one side of each of the first and second plates 84A and 84B, while each long side of the other of the first closing plates 85 is put in contact with a side opposite to said one side, whereby first closing plates 85 are arranged parallel to each other and spaced by a predetermined distance from each other. First closing plates 85, first and second plates 84A and 84B define in a direction a first passage 87 through which air discharged from the drum 24 passes. Each long side of one of the second closing plates 86 is put in contact with a side perpendicular to said one side of each of the second and third plates 84B and 84C, while each long side of the other of the second closing plates 86 is put in contact with a side opposite to said perpendicular side, whereby second closing plates 86 are arranged parallel to each other and spaced by a predetermined distance from each other. Second closing plates 86, second and third plates 84B and 84C define a second passage 88 in a direction perpendicular to that direction in which the first passage 87 is directed. The second passage 88 allows outside air to pass therethough.

Assemblies 83 thus arranged are juxtaposed one another in a predetermined direction with the first plate 84A in an assembly connected to the third plate 84C in another adjacent assembly. The heat exchanger 82 is thus formed to a substantially rectangular solid and provided with plural first and second passages 87 and 88 which are arranged alternately and perpendicularly to each other. A sheet of plate serves as first and third plates 84A and 84C of adjacent assemblies in the embodiment as described above.

The heat exchanger 82 is arranged in the heat exchanger chamber 72 in such a way that the plate 84A, 84B and 84C vertically extend parallel with one another and that the first passages 87 are slanted inward the outer box by 45 degrees relative to the vertical direction. The side edges of heat exchanger 82 are attached to the front panel 12*a* and the case 66. The side at which the inlet side of each first passage 87 is opened in the heat exchanger is positioned to shut off the communication between the heat exchanger chamber 72 and the ventilating cylinder portion 76. The case 66 is cut away to form an opening 89 at a portion facing to the side at which the outlet side of each first passage 87 is opened in the heat exchanger 82. The outlet side of each first passage 87 is thus communicated with the space 25 through the opening 89. Therefore, the drum 24 is communicated with the space 25 through the ventilating cylinder portion 76 and first passages 87. The side at which each second passage 88 of heat exchanger 82 is opened is positioned facing to the front panel 12*a* and slanted 45 degrees relative to the front panel 12*a*, which is provided with an inlet hole 90 at a portion thereof facing to this side in the heat exchanger chamber 72. The inlet side of each second passage 88 is thus communicated with outside the outer box 12 through the inlet hole 90 and an upper space 91, which is defined by the side at which the inlet side of each second passage 88 of heat exchanger 82 is opened and by the case 66. A filter 92 is detachably attached to the opening 90. A lower space 93 defined by the side at which the outlet side of each second passage 88 of heat exchanger 82 is opened and by the case 66 is communicated with the motor chamber 68. The lower space 93 is thus communicated with outside the outer box 12 through the motor chamber 68, suction opening 73, fan chamber 70 and air discharging opening 75.

Numeral 94 in FIG. 4 represents a guide groove for guiding condensed water formed on the bottom of heat exchanger chamber 72. Numeral 95 in FIG. 2 represents a drain hole formed in the bottom of the outer box 12 and numeral 96 denotes a stand. In FIG. 1, numeral 97 denotes a timer attached to the front panel 12*a* and numeral 98 a switch for selecting either a high or low temperature setting on the heater.

The operation of the drying apparatus 10 thus constructed will be described.

Materials such as under wears to be dried are put into the drum 24 through the opening 16 and the opening 16 is closed by the door 18. The timer 97 is set to drive the motor 50 and heat the heater 72. The motor 50 thus driven rotates the fan 56 and fan 74, and the drum 24 through the belt 54. When the fan 56 is rotated, air in the space 25 between the outer box 12 and the drum 24 is taken into the fan casing 58 through the suction hole 60 and supplied to the duct portion 62. This air is heated by the heater 64 to hot air when it passes through the duct portion 62, guided into the chamber 36 in the wind spreading member 32 through the communicating hole 63, and then supplied into the drum 24 through the ventilating bores 38. Hot air supplied into the drum 24 passes through and around materials which are being stirred in the drum 24, takes moisture from materials, becoming moister and moister, and is then discharged through the air discharging opening 78. Air thus discharged is sent to the heat exchanger 82 passing through the ventilating path defined by the ventilating cylinder portion 76 and front panel 12*a*, and lints floating in this air are removed by the lint filter 79 at this stage. Air sent to the heat exchanger 82 flows through the first passages 87 and then through the opening 89 into the space 25.

When the fan 74 is rotated, outside air is sucked into the upper space 91 through the filter 92 and inlet hole 90. Air thus sucked is sent to the heat exchanger 82 passing through the upper space 91, passed through the second passages 88 to cool second and third plates 84B and 84C, and then discharged into the lower space 93. The upper space 91 serves as a ventilating path for guiding outside air to the heat exchanger 82. Outside air discharged into the lower space 93 is flowed into the motor chamber 68 to cool the motor 50 and then discharged outside the outer box 12 through the suction hole 73, fan chamber 70 and discharging opening 75. Since second and third plates 84B and 84C of heat exchanger 82 are cooled by outside air, hot and moist air passing through the first passages 87 is also cooled by these cooled second and third plates, and moisture in this air is removed condensing on first passage surfaces of first and second plates 84A and 84B. This air thus becomes low in temperature and dried and is dicharged into the space 25 through the outlet side of each first passage 87. Since the outer box 12 is held low in temperature contacting directly with outside air, air discharged into space 25 is further cooled contacting with the inner surface of the outer box 12 and moisture in this air is removed condensing on the inner surface of the outer box. Cooled and dried air in the space 25 is again sucked by the fan 56 into the fan casing 58 through the suction hole 60, heated by the heater 64 and then supplied into the drum 24. As apparent from the above, the space 25 serves as a ventilating path for guiding air discharged from the heat exchanger 82 to the heater 64. As described above, materials in the drum 24 are dried by air circulating in the outer box 12. On the other hand, dew drops condensed on first and second plates 84A and 84B of the heat exchanger 82 flow along these plates into the guiding groove 94 and then into the outer box through a small hole (not shown). This condensed water drained into the outer box 12 is combined with water condensed on the inner surface of the outer box and then drained outside the outer box through the drain hole 95.

According to the drying apparatus 10 constructed as described above, the heat exchanger 82 is formed by piling plural plates 84A, 84B and 84C with plural pairs of first and second closing plates 85 and 86 interposed therebetween, so that it becomes simpler in construction, easier in assembling operation and lower in manufacturing cost as compared with the heat exchanger of pipe type. In addition, each of plates 84A, 84B, 84C, and first and second closing plates 85, 86 is made of plastic and therefore more advantageous in its anti-corrosion, weight, and processability.

Each of first and second passages 87 and 88 is of flat box shape and has a cross-sectional area larger than that of conventional pipe. Therefore, the speed of air flowing through each of passages 87 and 88 is made slower and the resistance to which air flowing through each of passages is subjected is reduced. The heat exchanging area of the first and second passages 87 and 88, that is, the surface area of the plates 84A, 84B and 84C is larger as compared with the heat exchanger of pipe type, thus allowing a higher moisture-removing efficiency to be attained. In addition, the first passages 87 are slanted 45 degrees relative to the vertical direction in the heat exchanger 82. Therefore, dew drops condensed on the plates 84A and 84B flow vertically by their gravity, while air discharged from the drum 24 flows upward along the first passages 87 which are slanted 45 degrees. The flowing direction of dew drops is not made right opposite to that of air, and it seldom or never happens that dew drops are pushed back by air flowing through the first passages 87 and that the flow of air is prevented by dew drops flowing vertically along the plates 84A and 84B. Dew drops condensed on the plates can be thus drained smoothly and air discharged from the drum 24 is allowed to smoothly flow through the first passages 87. Being relatively large in their cross sectional area as described above, the first and second passages 87 and 88 are not jammed by fine lints and dust which have not been removed by the lint filter 79 and filter 92.

The outside air inlet hole 90 is usually arranged in the front or side panel of the outer box 12. The reason resides in that if the outside air inlet hole 90 is arranged in the roof panel of the outer box, the attaching and removing operation of the filter 92 is made troublesome or the distance between the roof panel of the outer box and the ceiling of a room in which drying apparatus 10 is installed becomes narrower making it difficult to smoothly such outside air and limiting the place where drying apparatus is installed, when drying apparatus 10 is mounted on the stand 96 as shown in FIGS. 1 and 2 and combined with a washing machine (not shown). When the outside air inlet hole 90 is provided in the front panel 12*a* of the outer box 12, an L-shaped duct, for example, must be arranged as a path through which outside air coming in through the inlet hole is guided to the heat exchanger. According to the example of drying apparatus 10, however, the heat exchanger 82 is arranged in the heat exchanger chamber 72 and the side at which the inlet side of the second passages 88 is opened in the heat exchanger is slanted 45 degrees facing opposite to the front panel 12*a*. In addition, the inlet hole 90 is formed in that portion of the front panel 12*a* which is faced opposite to this side, and the upper space 91 in the heat exchanger chamber 72 serves as the ventilating path through which outside air is guided to the heat exchanger 82. Therefore, no special duct or the like is needed as this ventilating path, thus enabling drying apparatus 10 to be made simpler in construction.

According to the drying apparatus 10, the space 25 between the outer box 12 and the drum 24 is employed as the ventilating path through which air whose moisture has been removed by the heat exchanger 82 is guided to the heater 64. Therefore, no special member such as duct is needed, thus making the drying apparatus 10 simpler in construction. In addition, air discharged from the heat exchanger 82 into the space 25 is further cooled and moisture-removed contacting with the inner surface of the outer box 12, thus enabling drying apparatus 10 to attain a higher moisture removing efficiency. Further, outside air passed through the heat exchanger 82 is discharged outside the outer box 12 via the motor chamber 68. The motor 50 arranged in the motor chamber 68 is therefore cooled by this outside air and prevented from being deteriorated in capacity. The motor chamber 68 is located nearer the air discharging side than the heat exchanger 82 is, in view of outside air flowing direction, so that the cooling capacity of the heat exchanger 82 can not be lowered by outside air.

Furthermore, the drum 24 can be positioned in the lower portion of the outer box 12, locating the heat exchanger 82 and motor 50 there above. The opening 16 is provided at the lower position accordingly, thus enabling materials, such as under wears, to be easily put into and taken out of the drum 24 even if drying apparatus 10 is mounted on the stand 96.

What is claimed is:

1. A drying apparatus comprising:

an outer box sealed substantially air-tightly, drum means rotatably arranged in the outer box for housing materials to be dried, driving means for rotating the drum, air supply means for supplying air into the drum to remove moisture from the materials, and heat exchanger means for cooling discharged air which has taken away moisture from the material and has been discharged from the drum by bringing outside air into heat exchange relationship with the discharged air to remove moisture from the discharged air, the supply means supplying air discharged from the drum into the drum through the heat exchanger and supplying outside air into the heat exchanger, wherein said heat exchanger comprises at least one assembly including:

(a) first, second and third plates, the first and third plates facing the second plate and separated therefrom by a predetermined dimension, (b) a pair of first opposing closing plates disposed between the first and second plates to form a first passage therebetween through which air discharged from the drum flows, (c) a pair of second opposing closing plates disposed between the second and third plates to form a second passage therebetween which extends at right angles to the first passage and through which the outside air flows, heat being exchanged through the second plate between the discharged air flowing in the first passage and the outside air flowing in the second passage, the assembly being so arranged in the outer box such that the first, second and third plates vertically extend parallel with one another and such that the first passage is inclined by a predetermined angle relative to the vertical direction to allow water drops, which form on the first and second plates by virtue of the heat exchange between the discharged air and outside air, to flow by gravity along the first and second plates opposite the airflow in said first passage, and wherein said apparatus further comprises means arranged under the heat exchanger to receive the water drips.

2. A drying apparatus according to claim 1 wherein said first, second and third plates are square and arranged parallel to one another.

3. A drying apparatus according to claim 2 wherein each of said first and second closing plates is rectangular having long sides each equal to one side of the first plate and short sides each equal to the distance between said two adjacent plates.

4. A drying apparatus according to claim 3 wherein the long sides of one of said first closing plates are put in contact with one sides of the first and second plates, respectively, and the long sides of the other are put in contact with opposite sides of the first and second plates, respectively.

5. A drying apparatus according to claim 4 wherein the long sides of one of said second closing plates are put in contact with another sides of the second and third plates, the another sides being perpendicular to the one sides of the first and second plates, and long sides of the other are put in contact with sides opposite to the another sides of the second and third plates.

6. A drying apparatus according to claim 5 wherein said outer box has a front panel and a pair of side panels, the front panel having an outside air inlet hole located above the drum, and the second passage having a inlet side opening slanted and facing to the outside air inlet hole.

7. A drying apparatus according to claim 6 further including a ventilating path formed in the outer box through which air passed through the first passages of the heat exchanger is guided to the air supply means.

8. A drying apparatus according to claim 7 wherein said drum is spaced a predetermined distance from the inner surface of the outer box and the ventilating path is a space defined by the outer surface of the drum and the inner surface of the outer box.

9. A drying apparatus according to claim 8 further including a case arranged above the drum and attached to the front and side panels of the outer box, a fan chamber, a motor chamber in which a driving means is housed, and a heat exchanger chamber in which the heat exchanger is housed, these chambers being defined by the front and side panels of the outer box and by the case, wherein the heat exchanger chamber is communicated with the inlet hole and motor chamber, which is communicated with the fan chamber, which is communicated with outside the outer box, and outside air coming into the heat exchanger through the inlet hole pass through the second passages of the heat exchanger and is then discharged outside the outer box through the motor and fan chambers.

10. A drying apparatus according to claim 1 wherein each of said first, second and third plates and of the first and second closing plates is made of plastic.

11. A drying apparatus according to claim 1 further including a ventilating path formed in the outer box through which air passed through the first passages of the heat exchanger is guided to the air supply means.

12. A drying apparatus according to claim 11 wherein said drum is spaced a predetermined distance from the inner surface of the outer box and the ventilating path is a space defined by the outer surface of the drum and the inner surface of the outer box.

13. A drying apparatus according to any one of preceding claims wherein said heat exchanger includes a plurality of the assemblies juxtaposed one another.

14. A drying apparatus according to claim 1, which further comprises a case arranged in the outer box and attached to the inner surface of the outer box, the heat exchanger and the driving means being disposed in the case, and wherein the case defines a cooling passage through which outside air discharged from the heat exchanger flows toward the driving means.

15. A drying apparatus according to claim 14, wherein said outer box has a discharge opening communicating with the cooling passage, the outside air discharged from the heat exchanger being discharged to the exterior of the outer box through the cooling passage and discharge opening.

* * * * *